US006752949B2

(12) United States Patent
Collins et al.

(10) Patent No.: US 6,752,949 B2
(45) Date of Patent: Jun. 22, 2004

(54) HANDLE CONFIGURATION FOR BRUSH PRODUCTION BY FUSION

(75) Inventors: James Collins, Greeneville, TN (US); Carroll Buckner, Morristown, TN (US); Kenan Bible, Del Rio, TN (US); Lloyd Etter, Morristown, TN (US)

(73) Assignee: Team Technologies, Inc., Morristown, TN (US)

( * ) Notice: Subject to any disclaimer, the term of this patent is extended or adjusted under 35 U.S.C. 154(b) by 135 days.

(21) Appl. No.: 09/836,779

(22) Filed: Apr. 17, 2001

(65) Prior Publication Data

US 2002/0069473 A1 Jun. 13, 2002

Related U.S. Application Data

(63) Continuation-in-part of application No. 09/465,209, filed on Dec. 15, 1999, now Pat. No. 6,260,928.

(51) Int. Cl.[7] ..... B29D 31/00

(52) U.S. Cl. ..... 264/243; 264/248; 264/250; 264/322; 264/271.1

(58) Field of Search ..... 264/250, 243, 264/248, 322, 271.1

(56) References Cited

U.S. PATENT DOCUMENTS

| | | | | |
|---|---|---|---|---|
| 4,609,228 A | | 9/1986 | Bickel | 300/4 |
| 4,637,660 A | | 1/1987 | Weihrauch | 300/21 |
| 4,741,066 A | * | 5/1988 | Ito et al. | 15/195 |
| 4,988,146 A | | 1/1991 | Weihrauch | 300/21 |
| 5,033,797 A | | 7/1991 | Rueb | 500/5 |
| 5,224,763 A | | 7/1993 | Dirksing | 300/21 |
| 5,344,218 A | | 9/1994 | Weihrauch | 300/2 |
| 5,622,411 A | | 4/1997 | Weihrauch | 300/21 |

FOREIGN PATENT DOCUMENTS

| | | |
|---|---|---|
| DE | 198 53 030 | 5/2000 |

OTHER PUBLICATIONS

The International Search Report for PCT/US00/34172 filed Jun. 7, 2001.

* cited by examiner

*Primary Examiner*—Edmund H. Lee
(74) *Attorney, Agent, or Firm*—Luedeka, Neely & Graham, P.C.

(57) ABSTRACT

A handle for use in production of brushes by fusion. The handle is injection molded with a set of pre-formed holes. Each hole contains, on its bottom surface, a protrusion of excess material. Bristles for the brush are heated to form a small fuse at their ends. When the fused ends are inserted into the holes, material from the protrusion flows around the fuses, retaining them in the holes upon cooling.

11 Claims, 3 Drawing Sheets

HANDLE CONFIGURATION FOR BRUSH PRODUCTION BY FUSION

This application claims the priority of and is a continuation in part of U.S. Ser. No. 09/465,209, filed Dec. 15, 1999, now U.S. Pat. No. 6,260,928, the entire contents of which are incorporated herein by reference.

FIELD OF THE INVENTION

This invention pertains to an improvement in methods for fusing bristles into a brush, and more specifically, to a configuration for a handle for use in fusion processes.

BACKGROUND OF THE INVENTION

Most brushware, especially toothbrushes, are produced via a two-part technique. The handles are produced by injection molding, following which the bristles are inserted into the handle. The most common technique for inserting the bristles into the brushes is stapling. The bristles are folded around a metal staple which is pushed into a pre-molded hole in the brush. The staple cuts into the plastic at the periphery of the hole, and the plastic retains both it and the bristles. However, it does not require great force to remove the bristles from the handle. Vigorous brushing can easily cause the bristles to be removed from the handle, leading to shedding or even release of the metal staple inside of the mouth.

Techniques wherein the bristles are fused with the handle can be used to produce brushes from which the bristles are not so readily removed. Either the bristles or the brush head, or both, are heated, and the bristles are inserted into holes in the handle where they are retained by the cooling plastic. Exemplary techniques for brush production by fusion include those described in U.S. Pat. No. 4,988,146, which describes a fusion process wherein the ends of bristle bundles are thermally fused, shortening and locally thickening the bundles to form a fuse-ball, or fuse. The fused bristles are inserted into holes in a brush handle which have a smaller cross-section than the fuse-ball. Either the fuse-ball or the wall of the hole may be heated to allow the fuse-ball to conform to the inside of the hole, or the bristles may be inserted into the hole immediately following fusion, before the fuse-ball is allowed to cool.

U.S. Pat. No. 5,224,763 discloses a fusion process in which holes are formed in the handles during the injection molding process. A collar of excess plastic disposed about the hole is swaged around the fused end of the bristles when it is inserted into the hole.

U.S. Pat. No. 5,622,411 discloses a fusion process wherein it is assumed that the fused bristles will displace a finite amount of material when they are inserted into holes in the handle head. The displaced material is compressed to form a planar surface in the head of the brush.

In each of these techniques, the inventor has sought a method of inserting bristles into pre-cored holes in the handle. However, it is not necessary to use a handle with prefabricated holes; the holes can be formed immediately prior to the insertion of the bristles. In a process called "hedgehogging," the handle is heated, and a set of short spikes mounted on a heated plate is pushed into the head of the handle to form holes to receive the bristles. U.S. Pat. No. 4,637,660 describes an exemplary hedgehogging process wherein, as the holes are formed in the handle, the displaced material is organized into a small bead surrounding the newly-formed hole. As in the '146 patent, the bristle ends are fused before they are inserted into the hedgehogged holes.

Material from the small bead flows around the fuse after it is fitted into the hole, enclosing the bristles in the brush head.

In most of these methods, a significant portion of the brush must be heated before the bristles are inserted into the hole whether it is pre-cored or hedgehogged. The only exception is the '146 patent, where the heated fuses may be inserted into the hole without heating the handle. In this case, the fuse expands against the walls of the hole, thermoforming the fuse and exerting hydrostatic pressure on the walls of the hole. In either case, excess post-molding processing of the handle will weaken the head and may cause it to warp. In addition, the fracture toughness of the head may be reduced. Many users bang their toothbrushes against the side of the sink to remove excess water after they are done brushing their teeth. This action is more likely to break a warped or pre-stressed brush head.

SUMMARY OF THE INVENTION

In one aspect, the invention is a bristle carrier for a brush which includes a bristle receiving portion, at least one pre-molded hole disposed in the bristle receiving portion, and a projection disposed in a bottom of the pre-molded hole. The hole is configured to receive a bristle tuft. A side surface of the protrusion may be perpendicular to the bottom of the hole, parallel to a wall of the hole, both, or neither. An upper surface of the protrusion may also exhibit a 3-dimensional contour. In addition, the wall of the hole need not be perpendicular to the bottom of the hole; it may be rounded or flat. A hole may include a plurality of protrusions; in a brush having a plurality of holes, the holes need not all have the same shape, and the shapes of the protrusions disposed in the holes may also vary. In addition, a wall of the hole need not be perpendicular to a surface of the bristle receiving portion that contains the opening of the hole.

In another aspect, the invention is a method of producing a brush. The method comprises forming a bristle carrier having at least one hole with a protrusion projecting from its bottom, heating the protrusion and a portion of the wall of the hole, and inserting a sheaf of bristles into the hole. When the protrusion is heated, material from it flows about the bristles, retaining them in the hole. The method may further comprise fusing an end of the sheaf of bristles to form a fuse-ball. This fuse may have a greater diameter than the diameter of the sheaf, and the fusion may be performed thermally or chemically. If the fusion is performed thermally, the sheaf may be inserted in the hole while the fuse-ball is still warm. A portion of the wall of the hole may be pressed around the fuse. Furthermore, the bristle carrier may be formed by either injection or compression molding.

BRIEF DESCRIPTION OF THE DRAWING

The invention is described with reference to the several figures of the drawing, in which.

DETAILED DESCRIPTION

Figure 1:
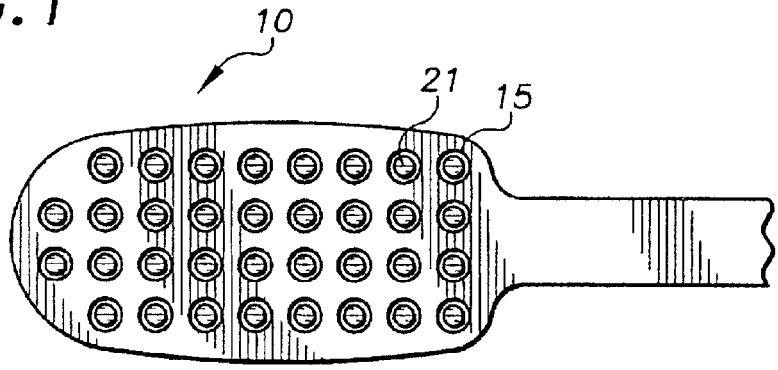
FIG. 1 is a diagram of the head portion of a toothbrush, before insertion of the bristles.
Figure 2A:
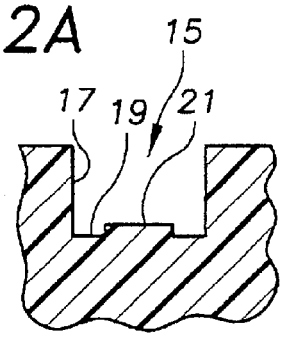
FIGS. 2A–E depict cross-sectional views of several embodiments of a hole in a brush head according to the invention.
Figure 2B:
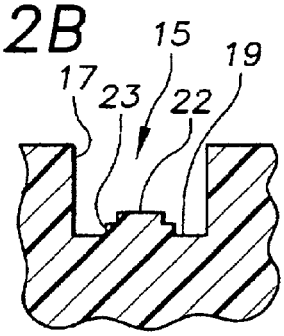
Figure 2C:
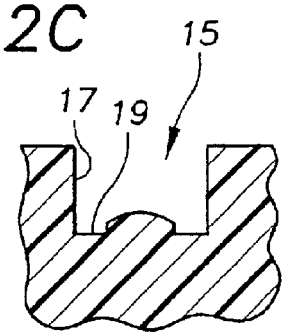
Figure 2D:
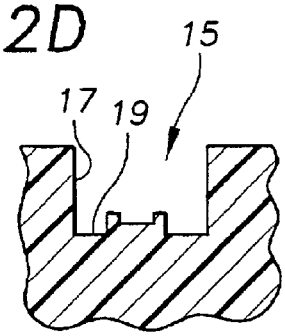
Figure 2E:
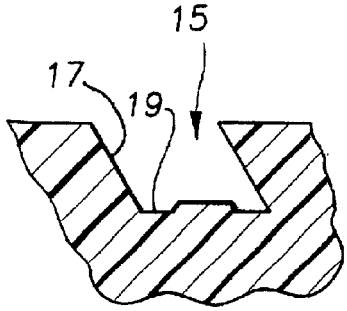
Figure 3A:
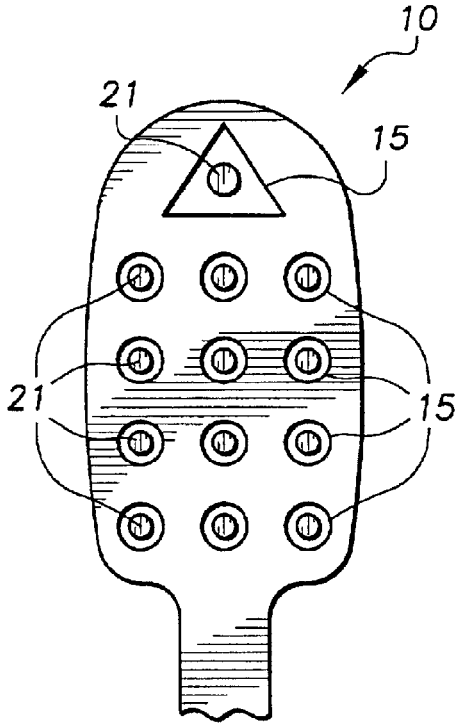
FIGS. 3A–D are diagrams of several exemplary arrangements of holes in brush heads.
Figure 3B:
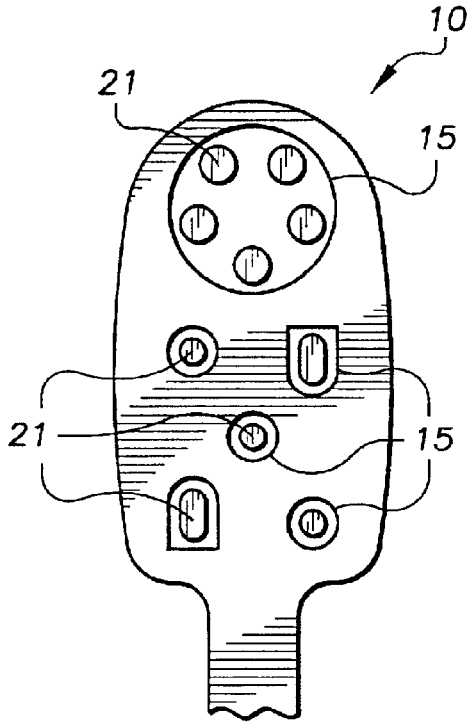
Figure 3C:
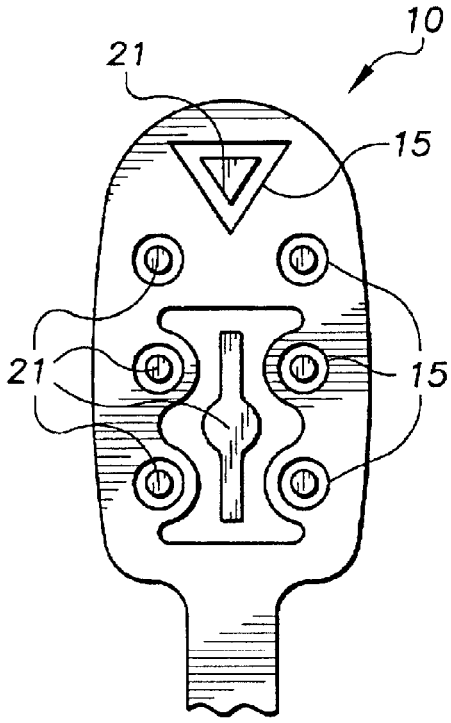
Figure 3D:
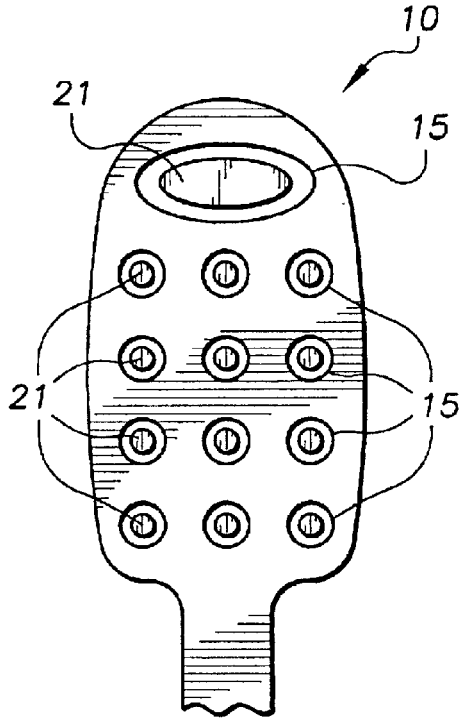

FIG. 1 shows an injection-molded handle for a brush including pre-cored holes. A cross-section of several exemplary holes 15 is shown in FIG. 2. Each hole has a wall 17 and a bottom 19, from which a protrusion 21 of excess material projects into the hole 15. The protrusion 21 is formed during injection molding of the brush handle, including head 10. In an alternative embodiment, the brush handle may be compression molded. The protrusion may be formed in a variety of shapes and sizes with respect to the hole. For example, the protrusion may be the same shape as the hole. Alternatively, it may be square, circular, triangular, or elliptical, or it may have an irregular shape including any combination of curved and shaped sides. Alternatively, the handle may be molded with a plurality of protrusions in any given hole. The protrusion need not be solid; it can be annular or adopt some other outline of a shape. An upper surface 22 of the protrusion may be flat, curved, or stepped, or it may be formed with some other 3-dimensional profile. Neither a side surface 23 of protrusion 21 nor the wall 17 need be perpendicular to the bottom 19 of hole 15. Because the hole 15 can take on a variety of shapes, the protrusion 21 may be adjusted accordingly to provide an optimal distribution of material, as shown in FIGS. 2A–E and 3A–D.

The handle configuration can be used for a variety of fusion processes. In one exemplary process, bristles are fed into a magazine at a station on a circular conveyor. The bristle bundles may be fed through holes in the magazine from an endless supply and cut to the desired length. Alternatively, the bristles may be fed into the magazine from a pre-cut supply. The holes in the magazine are configured to match the arrangement of holes in the handle, which may adopt a variety of shapes and sizes. Some exemplary hole or bristle configurations with which the invention can be used are shown in FIGS. 3A–D. One skilled in the art will recognize that the bristle bundles in the completed brush need not all be parallel to one another nor perpendicular to the face of the brush.

At subsequent stations on the conveyor, the bristles are end-rounded and profiled. Appropriate end-rounding and profiling methods are well-known in the art. In general, end-rounding is performed by sanding pads which rotate in an elliptical motion, abrading the end of the bristles to round the sharp corners. Profiling may be performed by any of several techniques. In one exemplary technique, pins approach the cut bundles from both the front and back sides of the magazine and push against the bundles, adjusting both the bundle heights and surface profile. Following profiling, the non-use ends of the bristles are trimmed to leave an even profile. During profiling and/or trimming, extra bristle strands may be added to the bundle.

Figure 4A:
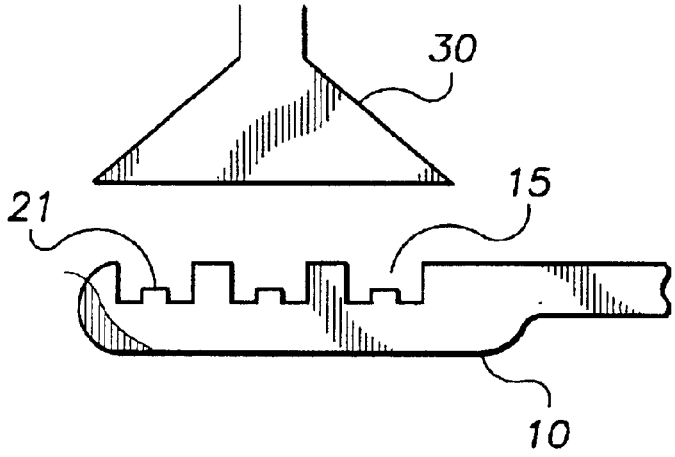
FIGS. 4A–C are a schematic diagram showing a method of brush production according to the invention.
Figure 4B:
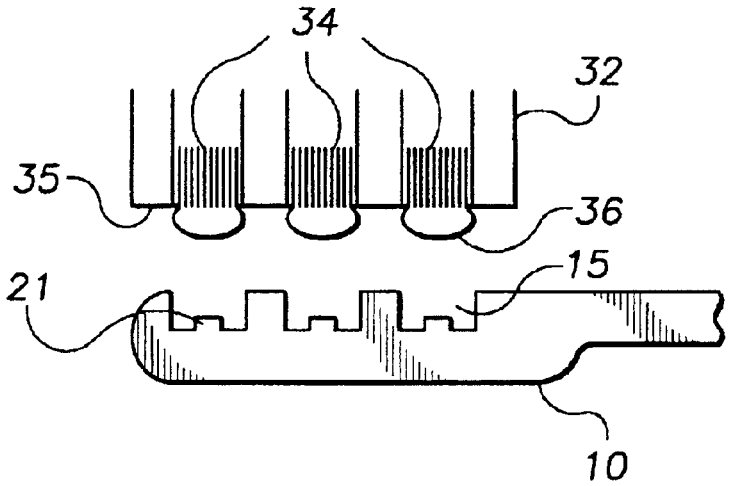
Figure 4C:
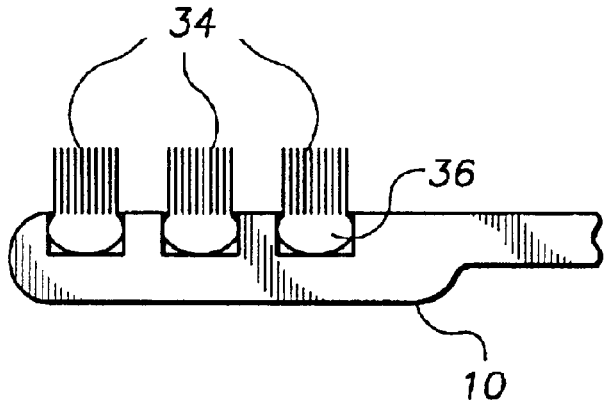

Following the bristle preparation process described above, the ends of the bristles are fixed in the brush head. The non-use ends of the bristles are heated to form a small ball, called a fuse-ball or simply a fuse. Preferably, the bristles are heated by a non-contact heater. Alternatively, the fuses may also be formed by a contact heater or hot air cannon, or chemically by softening a portion of the bristles with a solvent. Like the bristles, the brush head 10 is also heated, preferably by a non-contact heater 30, as shown in FIG. 4A. In FIG. 4B, a magazine 32 is shown holding bristle bundles 34 just before fused ends 36 are inserted into holes 15. The diameter of the hole 15 is typically larger than that of the fuse 36. When the fuse 36 is inserted into the hole 15, the excess material in protrusion 21 flows around the fuse 36 to fix the bristles 34 in the hole 15. Thus, the fuse 36 is retained in the head 10 of the brush without expanding the walls 17 of the hole 15, as shown in FIG. 4C. As the fuses 36 are inserted into the holes 15, the heated material in the head 10 may flow somewhat. The face 35 of the magazine 32 from which the fused ends 36 of the bristles 34 project may be contoured or stepped to mold the flowing material and provide a shape to the face of the head 10, and a portion of the walls 17 may be swaged around the fuses 36. The completed brushes are ejected from the machine, and the used magazine 32 returned to the beginning of the conveyor to begin the process anew.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method of producing a brush, comprising:

forming a bristle carrier including at least one hole having a protrusion projecting from a bottom of the hole;

heating the protrusion and at least a portion of the wall of the hole; and inserting a sheaf of bristles into the hole, wherein when heated, material from the protrusion flows about the bristles, retaining them in the hole, and the sheaf of bristles is not perpendicular to a surface of the bristle carrier containing an opening of the hole.

2. The method of claim 1, further comprising fusing an end of the sheaf to form a fuse-ball having a greater diameter than a diameter of the sheaf.

3. The method of claim 2, wherein the fusing is performed thermally or chemically.

4. The method of claim 2, wherein the fusing is performed thermally, and wherein the sheaf is inserted in the hole while the fuse-ball is still warm.

5. The method of claim 3, further comprising pressing a portion of the wall of the hole around the fuse.

6. The method of claim 2, wherein the step of forming comprises injection molding or compression molding.

7. A method of producing a brush, comprising:

forming a bristle carrier including at least one hole having a protrusion projecting from a bottom of the hole;

heating the protrusion and at least a portion of a side-wall of the hole;

fusing an end of a sheaf of bristles to form a fuse-ball having a greater diameter than a diameter of the sheaf; and inserting the sheaf of bristles having the fuse-ball at the end thereof into the hole, wherein, when heated, material from the protrusion flows about the bristles, retaining them in the hole, and the steps of heating ad fusing are conducted in a manner selected from any order and simultaneously.

8. The method of claim 7, wherein the fusing is performed thermally or chemically.

9. The method of claim 8, wherein the fusing is performed thermally, and wherein the sheaf is inserted in the hole while the fuse-ball is still warm.

10. The method of claim 7, further comprising pressing a portion of the side-wall of the hole around the fuse-ball.

11. The method of claim 7, wherein the step of forming comprises injection molding or compression molding.

* * * * *